United States Patent [19]

Ringwald

[11] Patent Number: 4,462,761

[45] Date of Patent: Jul. 31, 1984

[54] PUMP, ESPECIALLY FOR PUMPING FUEL FROM A STORAGE TANK TO AN INTERNAL COMBUSTION ENGINE

[75] Inventor: Peter Ringwald, Rutesheim, Fed. Rep. of Germany

[73] Assignee: Robert Bosch GmbH, Stuttgart, Fed. Rep. of Germany

[21] Appl. No.: 344,773

[22] Filed: Feb. 1, 1982

[30] Foreign Application Priority Data

May 9, 1981 [DE] Fed. Rep. of Germany ..... 3118534

[51] Int. Cl.[3] ..... F04B 23/14; F04D 5/00

[52] U.S. Cl. ..... 417/203; 415/53 T; 415/106

[58] Field of Search ..... 417/203; 415/53 T, 106, 415/143, 198.2, 213 T

[56] References Cited

U.S. PATENT DOCUMENTS

| | | | |
|---|---|---|---|
| 3,973,865 | 8/1976 | Mugele | 415/53 T |
| 4,205,947 | 6/1980 | Ruhl et al. | 417/203 |
| 4,295,797 | 10/1981 | Ruhl et al. | 417/203 |
| 4,336,002 | 6/1982 | Rose et al. | 417/203 |

FOREIGN PATENT DOCUMENTS

| | | | |
|---|---|---|---|
| 2745792 | 4/1979 | Fed. Rep. of Germany | 417/203 |
| 2745818 | 4/1979 | Fed. Rep. of Germany | 417/203 |
| 3014080 | 10/1981 | Fed. Rep. of Germany | 418/225 |
| 363812 | 2/1973 | U.S.S.R. | 415/106 |

*Primary Examiner*—Carlton R. Croyle
*Assistant Examiner*—Timothy S. Thorpe
*Attorney, Agent, or Firm*—Michael J. Striker

[57] ABSTRACT

A pump which is especially suited for pumping fuel from a storage tank to an internal combustion engine includes a rotatable impeller wheel having an annulus of impeller vanes defining respective compartments therebetween which open onto one axial surface of the impeller wheel which extends substantially normal to the axis of the rotation of the impeller wheel, and an end wall having an end surface which is juxtaposed with the axial surface of the impeller wheel and defines an interface therewith. The end wall is provided with a pumping channel which extends along a part-annular course along the trajectory of orbiting movement of the impeller vanes and opens onto the interface. The pressure of the fluid being pumped by the impeller vanes increases in the downstream direction of the pumping channel and exerts a tilting moment about an axis normal to the rotation axis on the impeller wheel. This tilting moment is counteracted by the action of a pressurized fluid confined in a pressure zone onto the axial surface of the impeller wheel, such pressurized fluid being advantageously derived from the output side of the pump. The pressure zone may be a separate additional channel of a sickle-shaped configuration situated outwardly of the pumping channel in the end wall, or a widened portion of an internal annular output channel.

7 Claims, 6 Drawing Figures

PUMP, ESPECIALLY FOR PUMPING FUEL FROM A STORAGE TANK TO AN INTERNAL COMBUSTION ENGINE

BACKGROUND OF THE INVENTION

The present invention relates to pumps in general, and particularly to a pump which is especially suited for pumping fuel from a storage tank to an internal combustion engine.

There are already known fuel pumps which include an impeller wheel including an annulus of impeller vanes or blades, and an end wall which is provided with a lateral pumping channel which is associated with the impeller vane annulus, the end wall being arranged in juxtaposition with an axial end face of the impeller wheel which extends parallel to the plane of rotation of the impeller wheel.

In the conventional pump constructions of this type, a tilting moment about a tilting axis normal to the axis of rotation of the impeller wheel acts on the impeller wheel, owing to the exposure of the latter to the pressure of the fluid being pumped, this pressure increasing in the downstream direction of the pumping channel as a result of the action of the impeller vanes on the fluid being pumped. This tilting moment results in a unilateral loading of the impeller wheel, so that the latter is tilted (immediately within the bearing play) about the tilting axis out of the intended plane of rotation. As a result of this tilting, the impeller wheel comes into contact with and drags along the end wall. In this manner, the mechanical losses attributable to friction increase. Moreover, the size of the axial gap or interface between the impeller wheel and the end wall, which is important for the pumping capacity of the pump of this type, is unilaterally increased. This, of course, is very disadvantageous since it results in a lower throughput and efficiency of the pump and an increased wear of the components which, in turn, results in an even larger increase in the size of the gap and, consequently, a further loss in the pumping capacity.

SUMMARY OF THE INVENTION

Accordingly, it is a general object of the present invention to avoid the disadvantages of the prior art.

More particularly, it is an object of the present invention to develop a pump of the type here under consideration which does not possess the disadvantages of the conventional pumps of this type.

Still another object of the present invention is so to construct the pump of the above type as to improve its efficiency and reduce its wear.

A concomitant object of the invention is so to design the pump as to be simple in construction, inexpensive to manufacture, and reliable in operation nevertheless.

In pursuance of these objects and others which will become apparent hereafter, one feature of the present invention resides, briefly stated, in a pump, especially for use in pumping fuel from a storage tank to an internal combustion engine, comprising a support; an impeller wheel mounted on the support for rotation about an axis and having an axial end face and an annulus of impeller vanes defining respective compartments therebetween which open onto the axial end face; means for rotating the impeller wheel about the axis for the impeller vanes to orbit the axis in an annular trajectory; an end wall stationary relative to the support and having an end surface facing the axial end face of the impeller wheel and defining an interface therewith, and a pumping channel open onto the end surface and extending along a part of the annular trajectory to convey the medium being impelled by the impeller vanes at a pressure which gradually increases in the downstream direction of the pumping channel and exerts a tilting moment on the impeller wheel; and means for counteracting the tilting moment.

When the pump of the type here under consideration is constructed in this manner, it has the advantage when compared to the conventional construction that the impeller wheel rotates in a moment-balanced manner, so that the gap between the axial end surface and the end face can be maintained at a minimum, and the mechanical friction-dependent losses of the pump can also be kept to the lowest possible level. Moreover, it is achieved that the size of the gap or interface, as well as the amount of frictional losses, remain substantially constant over the lifetime of the pump.

In accordance with a currently preferred aspect of the present invention, the counteracting means includes means for defining a pressure zone in the end wall which opens onto the interface, and means for supplying pressurized fluid to the pressure zone, the pressure of such pressurized fluid and the magnitude and location of the pressure zone being such that the pressurized fluid in the pressure zone exerts a counter moment on the impeller wheel which substantially counteracts the tilting moment.

In an advantageous construction in accordance with this aspect of the invention, the impeller wheel and the end wall together form a pumping unit having an inlet and an outlet, and the supplying means includes means for communicating the pressure zone with the outlet.

It is particularly advantageous when the defining means includes means for bounding a substantially sickle-shaped additional channel at the end surface of the end wall. The additional channel is advantageously situated radially outwardly of the pumping channel.

However, it is also advantageous when, in accordance with a further facet of the present invention, the pumping channel includes an upstream and a downstream portion, when the end wall further bounds an outlet which opens onto the interface and includes a substantially radially extending connecting portion communicating with the downstream portion of the pumping channel and an annular portion surrounding the axis and communicating with the connecting portion, and when the defining means includes means for increasing the radial width of the annular portion of the outlet at a region situated opposite to the connecting portion of the outlet relative to that adjacent to the connecting portion.

Advantageously, the impeller wheel and the end wall which together constitute a pumping unit are used as an initial pumping station of the pump which additionally comprises an additional pumping unit arranged downstream of the first-mentioned pumping unit and advantageously constructed as a roller piston pump. It can be achieved in this manner that, by combining the advantageous properties of these two types of pumping units, the medium being pumped obtains the desired characteristic values, such as volumetric flow rate and pressure, at low cost of the pump.

The novel features which are considered as characteristic of the invention are set forth in particular in the appended claims. The improved pump itself, however, both as to its construction and its mode of operation, together with further features and advantages thereof, will be best understood upon perusal of the following detailed description of certain specific embodiments of the pump of the present invention with reference to the accompanying drawing.

DETAILED DESCRIPTION OF THE PREFERRED EMBODIMENTS

Figure 1:
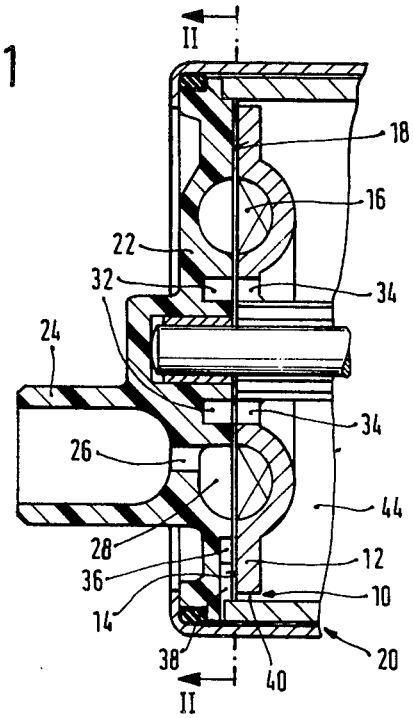
FIG. 1 is a fragmentary longitudinal sectional view of a pump according to the present invention.

Referring now to the drawing in detail, and first to FIG. 1 thereof, it may be seen that the reference numeral 10 has been used to identify a so-called lateral channel pump according to the invention in its entirety. The pump or pumping unit 10 includes, as one of its components, an impeller wheel 12 which has an axial end surface 14 extending parallel to the plane of rotation of the impeller wheel 12. The impeller wheel 12 includes an annulus of impeller blades or vanes 16 which bound respective pumping compartments with one another, such compartments opening onto the axial end surface 14 of the impeller wheel 12. The pumping unit 10 further includes an end wall 22 having an axial end face 18 which faces the axial surface 14 of the impeller wheel 12 and bounds an interface or gap therewith. The end wall 22 constitutes another component of the pumping unit 10, and also forms an end wall of a housing 20 which is arranged around the trajectory of movement of the impeller wheel 12.

The end wall 22 is provided with a connecting nipple 24 which is connected, through a suction or inlet opening 26, with a pumping channel 28 which is provided in the end wall 22 and opens onto the end face 18 and thus into the interface.

Figure 2:
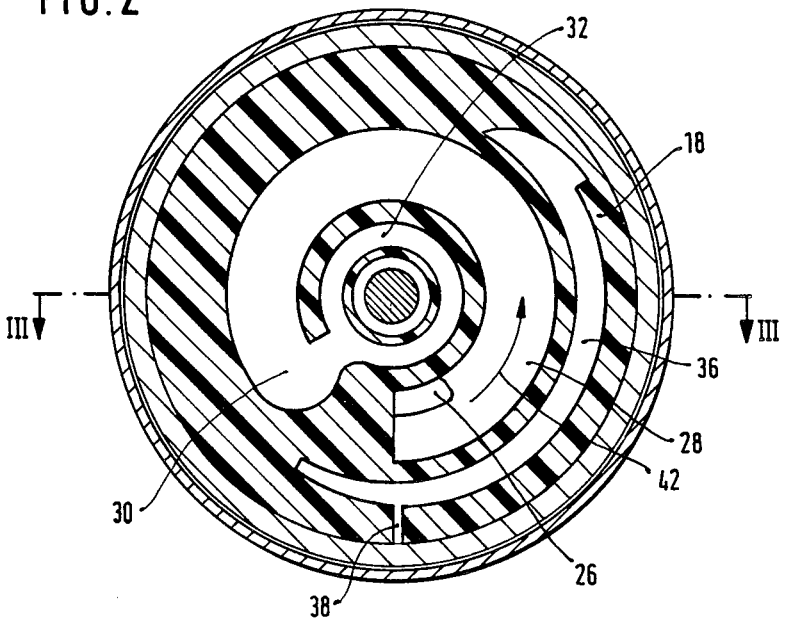
FIG. 2 is a cross-sectional view taken along the line II—II of FIG. 2.

As shown in FIG. 2, in which the end wall 22 is shown in cross section in order to be able to better reveal one important aspect of the invention, the lateral pumping channel 28 is formed by a partly annular groove or recess in the end wall 22 which extends through about 330° along the trajectory of movement of the impeller blades 16 during the rotation of the impeller wheel 12 and which is open onto the interface between the end wall 22 and the impeller wheel 12. The pumping channel 28 has an upstream portion which communicates with the suction or inlet opening 26, and a downstream portion which merges into a substantially radially inwardly extending connecting channel 30. The connecting channel 30 connects the downstream portion of the pumping channel 28 with an annular channel 32 and forms an outlet with the latter. The annular channel 32 surrounds the axis of rotation of the impeller wheel 12 and is situated inwardly of the pumping channel 28.

As may be best ascertained from FIG. 1, the impeller wheel 12 has apertures 34 adjacent to its hub portion, these apertures being substantially aligned with the annular channel 32 and permitting fluid exiting from the latter to pass through the impeller wheel 12.

FIG. 2 also shows that a substantially sickle-shaped additional channel 36 is provided in the end wall 22 radially outwardly of the pumping channel 28. The additional channel 36 opens onto the end surface 18 of the end wall 22, extends through about 180° around the axis of rotation of the impeller wheel 12, and commences substantially at the region of the radial connecting channel 30. The additional channel widens in direction to its other end which is situated substantially radially opposite to the connecting channel 30. An auxiliary channel 38, which extends substantially outwardly of the additional channel 36, connects the additional channel 36 with the output side of the pump. As can be seen especially in FIG. 1, the connection with the output side is established through a gap 40 which is present between the outer circumferential surface of the impeller wheel 12 and the inner circumferential surface of the housing 20.

Figure 3:
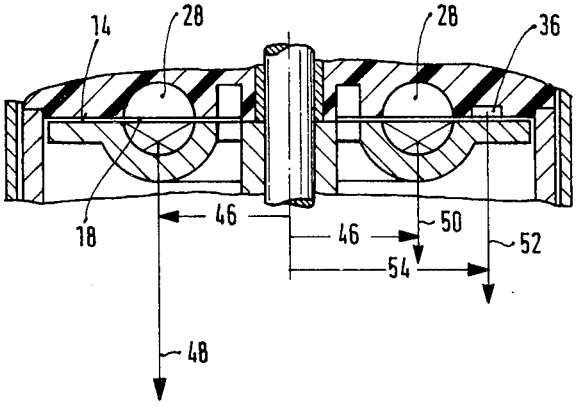
FIG. 3 is a fragmentary longitudinal sectional view of the pump according to FIG. 1 taken along the line III—III of FIG. 2.

Having so discussed the construction of the arrangement depicted in FIGS. 1 and 2, the operation thereof will now be discussed especially in connection with FIGS. 3 and 4 which contain information as to the forces and pressures existing at various regions of the pumping unit.

During the operation of the pumping unit, that is, when the impeller wheel 12 rotates about its rotational axis, the fluid or medium to be pumped, especially liquid fuel or a similar liquid, is drawn into the annular pumping channel 28 through the suction or inlet opening 26. Then, the action of the impeller vanes 16 of the rotating impeller wheel 12 on the fluid present in the compartments between the individual impeller vanes 16 and in the pumping channel 28 causes the fluid to propagate from the upstream portion to the downstream portion of the pumping channel 28, that is, in the direction of an arrow 42 (see FIG. 2). The pressure of the fluid being pumped or advanced in the downstream direction of the pumping channel 28 increases with increasing distance from the upstream end of the pumping channel 28. From the downstream portion of the pumping channel 28, the fluid being pumped flows into the substantially radially inwardly extending connecting channel 30 and from there into the annular channel 32. From there, the fluid flows through the apertures 34 formed in the impeller wheel 12 into an inner space 44 surrounded by the housing 20, so that the pumping or output pressure prevails in the inner space 44 of the housing 20. This output pressure propagates through the gap 40 and the auxiliary channel 38 from the inner space 44 into the substantially sickle-shaped additional channel 36. The housing 20 is provided with a conventional outlet nipple or port, which has been omitted from the drawing in order not to unduly encumber the same, this outlet port being connected, when the pumping unit is used as a fuel pump accommodated in a storage tank, to an also omitted conduit leading to an internal combustion engine.

Figure 4:
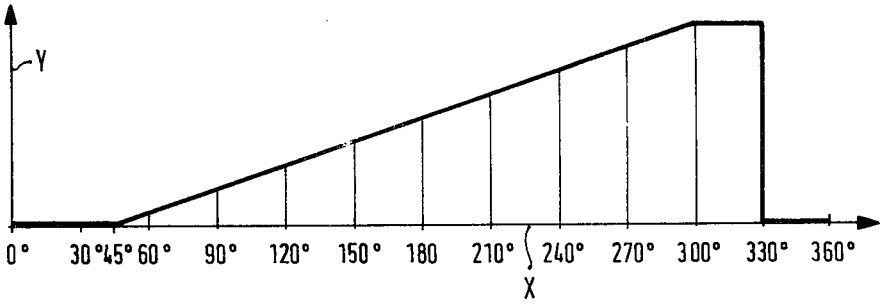
FIG. 4 is a graphic representation depicting the behavior if the pressure of the medium being pumped along the length of the pumping channel.

Referring now to the diagram of FIG. 4, it may be seen that the abscissa X thereof represents a developed circumference of the end wall 22 taken at the radius of the pumping channel 28, while the ordinate Y represents the pumping pressure as it exists at this circumference. The graduation of the abscissa X is in angular degrees which correspond to those of FIG. 2, commencing at the upstream end of the pumping channel 28 and continuing in the counterclockwise direction. It may be seen in FIG. 4 that, at the region of the suction opening 26, for about the initial 45°, there is substantially no pressure build-up in the pumping channel 28. From there on, for about 255°, there is a gradual uniform pressure build-up in the pumping channel 28. Then, at the region of the radial connecting channel 30, that is, substantially between 300° and 330°, the pressure in the pumping channel 28 remains constant. At the region between 330° and 0° or between 330° and 360°, the pumping channel 28 is interrupted, so that the pressure in this region is at the level of the ambient pressure.

As a result of this increase in the pressure effective on the end face 14 of the impeller wheel 12 at the various regions of the pumping channel 28 as considered in the downstream direction of the latter and in the circumferential direction of the impeller wheel 12 at the region of the impeller blades 16, a tilting moment acts on the rotating impeller wheel 12. The magnitude of this tilting moment is determined by the mean radius 46 of the pumping channel 28 (see FIG. 3) and the pressures effective at the various points along the pumping channel 28. In FIG. 3, a vector 48 indicates the magnitude of the forces resulting from the pressures in the pumping channel 28 as they exist at one side of a plane normal to that of FIG. 3 and including the axis of rotation, while a vector 50 is indicative of the magnitude of similar forces effective at the other side of the same plane. It may be seen that, since both vectors 48 and 50 are effective at the same radius 46, the tilting moment caused by the vector 48 outweighs that resulting from the vector 50. Thus, the resultant tilting moment will attempt to and actually tilt the impeller wheel 12 at least within the range given by the manufacturing tolerances, so that the surfaces 14 and 18 will come close to one another and will frictionally engage each other at the region opposite to the radial connecting channel 30, and become spaced from each other at the region of the radial connecting channel 30 where the pressure and, consequently, the leakage losses, are the greatest. However, in contradistinction to the conventional constructions of the pumping unit of this type, where this tilting moment is the only moment acting on the impeller wheel 12 in this manner, in the pumping unit according to the present invention, this undesirable tilting of the impeller wheel 12 is avoided in that the pumping unit is so constructed as to obtain balancing of the moment acting on the impeller wheel 12. This is achieved in accordance with the present invention in that the fluid contained in the additional channel 36 which defines a pressure zone exerts a force on the impeller wheel 12 which is represented by a vector 52 in FIG. 3. This vector 52 exerts a counter moment on the impeller wheel 12 which is opposed to the tilting moment excess as discussed above and the magnitude of which is determined not only by the magnitude of the vector 52, but also by the length of a mean radius 54 on which this vector 52 is effective. Thus, it may be seen that, by properly selecting the effective area of the additional channel 36 and its orientation relative to the pumping channel 28, substantially as shown in FIG. 2, it is possible to obtain such a magnitude of the counter moment as to fully compensate for the excess tilting moment exerted by the fluid flowing through the pumping channel 28.

Figure 5:
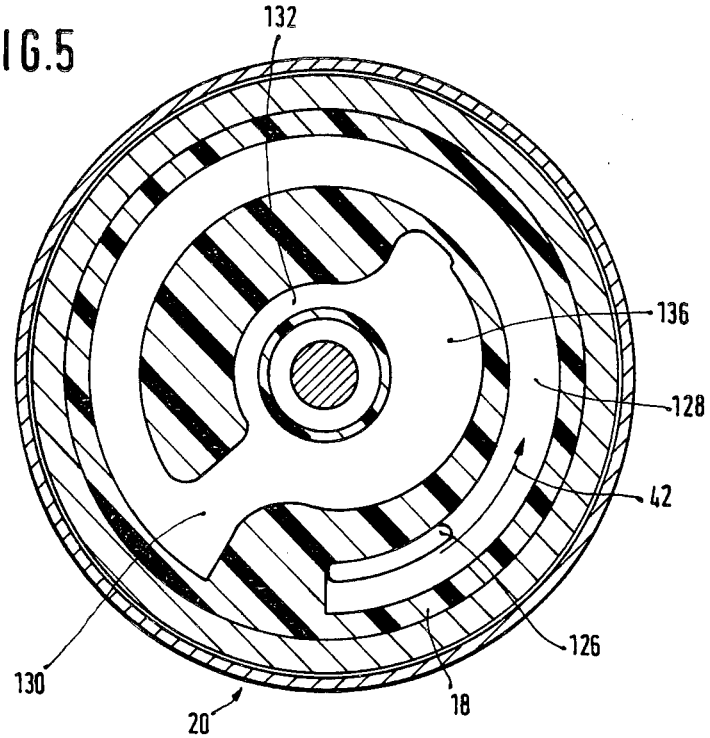
FIG. 5 is a view similar to FIG. 2 but showing a modified version of the pumping unit of the present invention.

The construction shown in FIG. 5 is based on the same principle as that discussed above, so that corresponding parts have been assigned either the same reference numerals, or reference numerals raised by 100 relative to those used before. The pumping channel 128 of FIG. 5 is shifted in the radially outward direction relative to that of FIG. 2, so that a relaitvely large spacing is obtained between the pumping channel 128 and the annular channel 132. The annular channel 132 is enlarged or widened over a certain region, in correspondence with the above-discussed pressure increase in the pumping channel 128. In this manner, there is obtained an additional channel 136 which is in direct communication with the annular outlet channel 132. The widened portion of the annular channel 132, which encompasses the additional channel 136, commences at the region of the inlet opening 126 and continues in the counterclockwise direction as considered in FIG. 5 to a region of the annular channel 132 which is situated substantially opposite to the connecting channel 130 which establishes communication between the pumping channel 128 and the annular outlet channel 132. Even in this particular construction, the additional channel 136 is connected with the pressure or output side of the pumping unit 10, inasmuch as the maximum pressure of the pumping unit 10 prevails at the region of merger of the downstream portion of the pumping channel 128 with the radial connecting channel 130. In this construction as well, the width and the location of the additional channel 136 must be so coordinated to the magnitude and orientation of the excess tilting moment resulting from the pressure in the pumping channel 128, such that preferably the counter moment exerted on the impeller wheel 12 by the pressurized fluid present in the additional channel 136 fully balances the aforementioned excess tilting moment.

Figure 6:
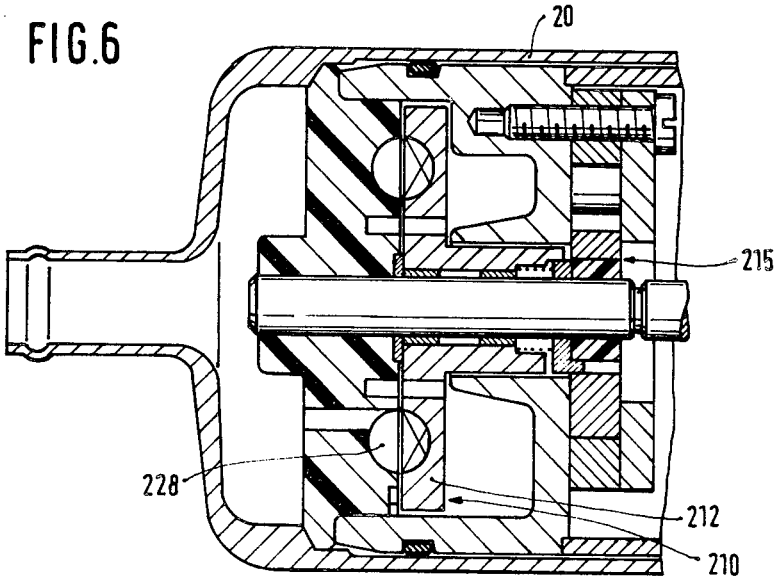
FIG. 6 is a longitudinal sectional view of a pump according to the present invention which, in addition to the pumping unit, includes a roller piston pumping unit arranged in the same housing as the first-mentioned pumping unit and downstream of the latter.

In the construction illustrated in FIG. 6, reference numerals raised by 100 relative to those used in FIG. 5 or by 200 relative to those used in FIGS. 1 and 2 have been used to identify similar parts to those discussed above. In this construction, the housing 20 is shown to include, in addition to a lateral channel pumping unit 210 of the type and construction discussed above, and including an impeller wheel 212, a pumping channel 228, also a roller piston pumping unit as disclosed for example in U.S. Pat. No. 4,295,797 215. The pumping unit 210 constructed in accordance with the present invention serves here as an initial stage of a multistage pump, whose second stage is constituted by the roller piston pump 215. The construction of the pumping unit 210 may advantageously correspond to that of the pumping unit 10 of FIGS. 1 to 3. However, it is also possible, without encountering any problems, to use the construction of the pumping unit as depicted in FIG. 5 in the pump of FIG. 6 as the initial stage arranged upstream of the pumping unit 215.

What is common to the above-discussed construction is that the lateral channel pumping units are provided with means 36 or 136 for counteracting or compensating for the excess tilting moment which results from the action of the pressure of the fluid being pumped in the lateral pumping channel 28 or 128 on the rotating impeller wheel 12 or 212.

It will be understood that each of the elements described above, or two or more together, may also find a useful application in other types of arrangements differing from the type described above.

While the invention has been illustrated and described as embodied in a pump especially suited for pumping fuel from a storage tank to an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A pump, especially for use in pumping fuel from a storage tank to an internal combustion engine, comprising a support; an impeller wheel mounted on said support for rotation about an axis and having an axial end face and only one annulus of impeller vanes defining respective closed compartments therebetween which open onto said axial end face; means for rotating said impeller wheel about said axis for said impeller vanes to orbit said axis in an annular trajectory; an end wall stationary relative to said support and having an end surface facing said axial end face of said impeller wheel and defining an interface therewith, and only one pumping channel open onto said end surface and extending along a part of said annular trajectory to convey the medium being impelled by said annulus of said impeller vanes at a pressure which gradually increases in the downstream direction of said one pumping channel and exerts a tilting moment on said impeller wheel; and means for counteracting said tilting moment which is exerted by the medium impelled by said only one annulus of impeller vanes and conveyed by said only one pumping channel, said counteracting means being associated with said only one pumping channel, said counteracting means includes means for defining a pressure zone in said end wall which opens onto said interface, and means for supplying pressurized fluid to said pressure zone, the pressure of such pressurized fluid and the magnitude and location of said pressure zone being such that the pressurized fluid in said pressure zone exerts a counter moment on said impeller wheel which substantially counteracts said tilting moment.

2. The pump as defined in claim 1, wherein said impeller wheel and said end wall together form a pumping unit having an inlet and an outlet; and wherein said supplying means includes means for communicating said pressure zone with said outlet.

3. The pump as defined in claim 1, wherein said impeller wheel and said end wall together constitute a pumping unit; and further comprising an additional pumping unit arranged downstream of said pumping unit and constructed as a roller piston pump.

4. The pump as defined in claim 1, wherein said counteracting means is formed solely in said end surface onto which said only one pumping channel is open.

5. A pump, especially for use in pumping fuel from a storage tank to an internal combustion engine, comprising a support; an impeller wheel mounted on said support for rotation about an axis and having an axial end face and an annulus of impeller vanes defining respective compartments therebetween which open onto said axial end face; means for rotating said impeller wheel about said axis for said impeller vanes to orbit said axis in an annular trajectory; an end wall stationary relative to said support and having an end surface facing said axial end face of said impeller wheel and defining an interface therewith, and a pumping channel open onto said end surface and entending along a part of said annular trajectory to convey the medium being impelled by said impeller vanes at a pressure which gradually increases in the downstream direction of said pumping channel and exerts a tilting moment on said impeller wheel; and means for counteracting said tilting moment, said counteracting means including means for defining a pressure zone in said end wall which opens onto said interface, and means for supplying pressurized fluid to said pressure zone, the pressure of such pressurized fluid and the magnitude and location of said pressure zone being such that the pressurized fluid in said pressure zone exerts a counter moment on said impeller wheel which substantially counteracts said tilting moment, said defining means including means for bounding a substantially sickle-shaped additional channel at said end surface of said end wall.

6. The pump as defined in claim 5, wherein said additional channel is situated radially outwardly of said pumping channel.

7. A pump, especially for use in pumping fuel from a storage tank to an internal combustion engine, comprising a support; an impeller wheel mounted on said support for rotation about an axis and having an axial end face and an annulus of impeller vanes defining respective compartments therebetween which open onto said axial end face; means for rotating said impeller wheel about said axis for said impeller vanes to orbit said axis in an annular trajectory; and end wall stationary relative to said support and having an end surface facing said axial end face of said impeller wheel and defining an interface therewith, and a pumping channel open onto said end surface and extending along a part of said annular trajectory to convey the medium being impelled by said impeller vanes at a pressure which gradually increases in the downstream direction of said pumping channel and exerts a tilting moment on said impeller wheel, said pumping channel including an upstream and a downstream portion, said end wall bounding an outlet which opens onto said interface and includes a substantially radially extending connecting portion communicating with said downstream portion of said pumping channel and an annular portion surrounding said axis and communicating with said connecting portion; and means for counteracting said tilting moment, said counteracting means including means for defining a pressure zone in said end wall which opens onto said interface, and means for supplying pressurized fluid to said pressure zone, the pressure of such pressurized fluid and the magnitude and location of said pressure zone being such that the pressurized fluid in said pressure zone exerts a counter moment on said impeller wheel which substantially counteracts said tilting moment, said defining means including means for increasing the radial width of said annular portion of said outlet at a region situated opposite to said connecting portion of said outlet relative to that adjacent to said connecting portion.

* * * * *